US006758720B2

(12) United States Patent
Chen

(10) Patent No.: US 6,758,720 B2
(45) Date of Patent: Jul. 6, 2004

(54) ATTACHABLE BREAST FORM ENHANCEMENT SYSTEM

(75) Inventor: David E. Chen, Walnut, CA (US)

(73) Assignee: Bragel International, Inc., Pomona, CA (US)

( * ) Notice: Subject to any disclaimer, the term of this patent is extended or adjusted under 35 U.S.C. 154(b) by 52 days.

(21) Appl. No.: 10/159,251

(22) Filed: May 31, 2002

(65) Prior Publication Data

US 2003/0224700 A1 Dec. 4, 2003

(51) Int. Cl.[7] ..... A41C 3/00

(52) U.S. Cl. ..... 450/57; 450/54; 450/58; 2/267

(58) Field of Search ..... 450/81, 88, 38, 450/54–57, 58, 71, 77, 82, 63; 2/267; 623/7, 8

(56) References Cited

U.S. PATENT DOCUMENTS

| | | | | |
|---|---|---|---|---|
| 817,020 A | * | 4/1906 | Thompson | 450/54 |
| 2,079,426 A | | 5/1937 | Schottenfels | 2/42 |
| 2,579,365 A | | 12/1951 | Conde | |
| 2,728,079 A | | 12/1955 | Williams | 2/42 |
| 2,793,369 A | | 5/1957 | Panighini | 2/42 |
| 2,844,151 A | | 7/1958 | Lemons | |
| 2,869,553 A | | 1/1959 | D'Or | 128/505 |
| 2,882,905 A | * | 4/1959 | Barg | 450/63 |
| 3,196,878 A | | 7/1965 | Hedu | |
| 3,280,818 A | | 10/1966 | Pankey et al. | 128/505 |
| 3,297,036 A | | 1/1967 | Williams | 128/505 |
| 3,556,107 A | | 1/1971 | Brumfield | 128/465 |

(List continued on next page.)

FOREIGN PATENT DOCUMENTS

| | | |
|---|---|---|
| DE | 0216441 | 7/1961 |
| FR | 989453 A | 9/1951 |
| FR | 1092914 | 4/1955 |
| GB | 0785851 | 11/1957 |
| GB | 2208785 A | 4/1989 |

OTHER PUBLICATIONS

Dr. Leonard's—America's Leading Discount Healthcare Catalog, p. 15. Natural Looking Breast Enhancer Pads Silicon Covered With Film.*

(List continued on next page.)

*Primary Examiner*—Gloria M. Hale
(74) *Attorney, Agent, or Firm*—Christie, Parker & Hale, LLP

(57) ABSTRACT

An attachable breast form enhancement system comprising a pair of breast forms adjoined by a connector. The breast forms have an interior surface with a pressure sensitive adhesive layer that adjoins to the user's breasts. The pressure sensitive adhesive layer can be a permanently grown pressure sensitive adhesive that has an adhesion force to the breast forms that is greater than a cohesion force to the user's breasts. The connector adjoins the separated breast forms by attaching to the inner sides of the breast forms and pulling the user's breasts together. The connector can be either permanently or removably attached to the breast forms. Several different configurations of breast forms and connectors are available to achieve the benefits of the present breast form system. The improved breast form system allows a user to eliminate use of traditional bras by simply adhering the pair of breast forms to the user's breasts/skin, and then adjoining the breast forms with the connector. The breast form system provides for enhancement of breast size and shape, as well as provides for customization of breast cleavage and push-up enhancement.

7 Claims, 7 Drawing Sheets

U.S. PATENT DOCUMENTS

| | | | | | |
|---|---|---|---|---|---|
| 3,749,102 | A | | 7/1973 | Wynants | 128/505 |
| 3,934,593 | A | | 1/1976 | Mellinger | 128/480 |
| 4,553,550 | A | | 11/1985 | Hattori | |
| 4,992,074 | A | | 2/1991 | Diaz | 450/81 |
| 5,352,307 | A | * | 10/1994 | Wild | 156/66 |
| 5,538,502 | A | * | 7/1996 | Johnstone | 450/63 |
| 5,755,611 | A | | 5/1998 | Noble et al. | |
| 5,792,292 | A | * | 8/1998 | Wild | 156/66 |
| D419,279 | S | | 1/2000 | Marco et al. | |
| 6,200,195 | B1 | | 3/2001 | Furuno et al. | |
| 6,231,424 | B1 | | 5/2001 | Valentin | 450/81 |
| 6,257,951 | B1 | | 7/2001 | DeMarco | 450/65 |
| 6,257,952 | B1 | | 7/2001 | Valentin | 450/81 |
| 6,283,820 | B1 | * | 9/2001 | Huang | 450/57 |
| 2001/0021620 | A1 | | 9/2001 | DeMarco | 450/81 |
| 2001/0027079 | A1 | | 10/2001 | Valentin | 450/41 |

OTHER PUBLICATIONS

Figures Only for Italian Patent No. 0521811 (May 1955).
Abstract and Figures Only for French Patent No. 2505620 (Nov. 19, 1982).

* cited by examiner

ATTACHABLE BREAST FORM ENHANCEMENT SYSTEM

FIELD OF THE INVENTION

The present invention relates to an attachable breast form enhancement system comprising a pair of breast forms adjoined by an enhancement connector. More specifically, the breast forms have a re-usable pressure sensitive adhesive layer for adjoining to the user's skin and are adjustably adjoined together by a connector that allows the user to customize the amount of breast cleavage and push-up enhancement.

BACKGROUND OF THE INVENTION

Women who, for whatever reason, are not satisfied with the size of their own breasts and desire larger, more shapely breasts must select among two alternative methods for enhancing their breast size, by either using rudimentary externally worn articles, such as foam pads and the like, or by undergoing a surgical operation to be fitted with a breast implant. Opting for use of a surgical breast implant carries with it the danger inherent in any surgical operation and can be quite expensive. In addition to the dangers inherent with the surgical operation is the potential health dangers that may be associated with using a particular type of breast implant, namely, the silicone breast implant. Accordingly, women wishing to enhance their physical appearance in a non-permanent and health-risk free manner opt to use one of the many types of externally worn articles.

A key feature of such externally worn article is that it look and feel natural so as to complement and not detract from the existing female breast that it is used to enhance. In addition to enhancing an existing breast, externally worn articles are designed to replace a female human breast that has been surgically removed. Externally worn articles that can be worn for the purpose of either enhancing or replacing human breasts are referred to a breast forms, and include a wide range of breast enhancers, breast inserts, and breast prostheses. A popular type of breast form has been made from a silicone gel material that is completely encased by plastic film material. The advantage of this type of breast form is that it looks like a natural human breast when worn and feels natural to the user, thus enhancing the self image and confidence of the user. Other breast forms, such as foam pads, water-filled pads and the like, do not afford the user these important qualities but, rather, look unnatural and feel foreign.

In addition to the demand for devices and methods for enhancing breast size and shape, there is also a demand for being able to use those devices and methods while wearing a full-range of clothing. For example, women wearing a backless dress or a halter top will not want to wear a traditional bra. As a result, bras have been developed that are both backless and strapless. Such backless, strapless bras have used non-permanent adhesives, such as a disposable double-sided tape, to secure the bra to the user. Known backless, strapless bras, however, have only provided limited means for enhancing breast size and shape. For example, known backless, strapless bras having full-sized cups are not designed to easily accommodate a breast form and do not use an adhesive that allows the user to easily remove and re-use the bra.

As a result, there exists a need for a breast form enhancement system that provides the benefits of a breast form, yet also the benefits of a backless, strapless bra. Furthermore, there exists a need for such a system having a permanent and re-usable adhesive that allows the user to position the breast forms in a desired position without concern of the breast forms shifting from that position. Moreover, such a system should have means for pushing-up the breasts and enhancing breast cleavage.

There also exists a need for an improved breast form to be used with an improved breast form enhancement system that is specially designed to accommodate women with sagging breasts. Known breast forms have a structure designed to enhance the lower portion of a user's breast and, therefore, are thicker in the regions that cover that portion. As a result, women who have sagging breasts may not be well suited to use the known breast forms because the known breast forms would only further exaggerate the degree of sagging of the breast because the lower portion of the breast is already larger and rounder than the upper portion of the breast. Therefore, it is desirable to have a breast enhancement system with a breast form that is specially adapted to counter-balance the effect of sagging breasts.

SUMMARY OF THE INVENTION

The present invention provides an attachable breast form enhancement system comprising a pair of breast forms adjoined by a connector. The breast forms have an interior surface with a pressure sensitive adhesive layer that adjoins to the user's breasts. The pressure sensitive adhesive layer can be a permanently grown pressure sensitive adhesive that has an adhesion force to the breast forms that is greater than a cohesion force to the user's breasts. The connector adjoins the separated breast forms by attaching to the inner sides of the breast forms and pulling the user's breasts together. The connector can be either permanently or removably attached to the breast forms. Several different configurations of breast forms and connectors are available to achieve the benefits of the present system. The present breast forms system allows a user to eliminate the use of traditional bras by simply attaching the pair of breast forms to the user's breasts/skin, and then adjoining the breast forms together with the connector.

Thus, the separated breast forms provide the user with the desired amount of breast size and shape enhancement, and the connector provides the user the desired amount of breast cleavage and push-up enhancement. Because users can control the placement of the breast forms on the users' skin, and can control how much the breasts are pulled together by the connector, the present invention provides users with a single system that allows them to customize the shape and size of their breasts, as well as their breast cleavage and push-up enhancement.

DETAILED DESCRIPTION

Figure 1:
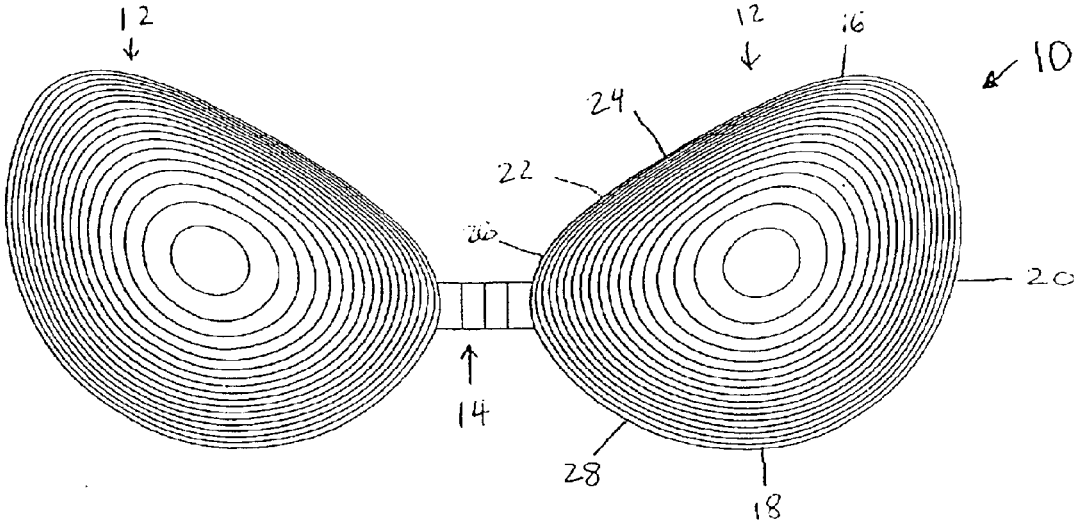
FIG. 1 is a front view of a breast form system having a pair of breast forms adjoined by a connector.

Breast form enhancement systems constructed according to principles of this invention, generally comprise a pair of breast forms adjoined by an enhancement connector. FIG. 1 illustrates a front view of a breast form system 10 of this invention. The breast form system 10 includes a pair of breast forms 12 adjoined by a connector 14 that is positioned between opposing surfaces of the two breast forms. The breast forms 12 each have a pressure sensitive adhesive layer that enables the breast forms to be removably attached to each of a user's left and right breasts. The breast forms 12 are separate articles that are independently placed on a left and right breast of a user. Each of the breast forms 12 has the same structure, except one is designed to support and enhance the left breast and the other is designed to support and enhance the right breast. Furthermore, each breast form is designed to adjoin with a portion of the connector 14, which allows the connector 14 to adjoin the two breast forms.

Generally, the user of the breast form system 10 positions the pressure sensitive adhesive layer of each of the breast forms 12 on the left and right breasts, and then adjoins the breast forms to each other by engaging the connector 14. The user can create varying degrees of breast cleavage and breast push-up enhancement depending on where the breast forms are positioned on the user's breasts and how much the connector 14 pulls the two breast forms towards each other. Furthermore, the placement of the connector relative to the top and bottom of the breast forms will impact the degree of cleavage and push-up enhancement. Accordingly, the breast form system 10 enables the user to position the breast forms at a position that creates a desired breast shape, and also allows the user to control the amount of cleavage and push-up enhancement by adjoining the breast forms with the connector.

The breast form system 10 can be formed from several different types of breast forms 12. The breast forms 12 are intended to include all types of externally worn articles that can be worn to enhance or replace a user's breasts. These include, but are not limited to, breast forms made from a volume of silicone gel encased by a thermoplastic film material. The breast forms also include any liquid, air, or gel encased by any foam, plastic, rubber, fabric, or molded unwoven fiber material, as well as any solid material that is suitable for external breast enhancement, such as a foam, soft rubber, fabric, molded unwoven fiber, or plastic. Accordingly, it is understood that a wide range of materials, structures, and sizes are within the scope of the breast forms 12 for purposes of this invention.

Figure 2:
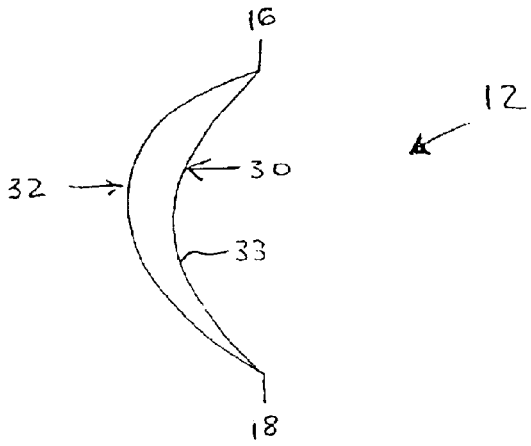
FIG. 2 is a side view of one of the breast forms shown in FIG. 1.

A front view of the breast forms 12 is shown in FIG. 1. Each breast form 12 has a top 16, a bottom 18 opposite the top, an outer side 20, and an inner side 22 opposite the outer side. Each breast form also defines an inner top 24, an inner middle 26, and an inner bottom 28. Referring to FIG. 2, each breast form 12 defines two surfaces relative to the user, a concave interior surface 30 facing towards the user's breasts, and an exterior surface 32 facing opposite the interior surface and away from the user's breasts. The interior surface 30 includes a pressure sensitive adhesive layer 33 that adjoins the breast forms to the user's skin.

The pressure sensitive adhesive layer 33 can include any type of pressure sensitive adhesive (PSA) that is suitable for removably attaching a breast form to a user's skin, such as various types and forms of double-sided tape and permanently grown PSAs. The pressure sensitive adhesive layer 33 allows the user to place each of the breast forms at a position on the user's breasts that will create a desired shape and look of the breasts. The amount and type of PSA comprising the pressure sensitive adhesive layer 33 can vary, as can the portions of the interior surface that have the pressure sensitive adhesive layer. Various factors can contribute to the amount, type, and placement of the pressure sensitive adhesive layer such as the size, shape, and weight of the breast form.

The pressure sensitive adhesive layer 33 is preferably a re-usable PSA that is permanently grown to the interior surface 30 of each breast form from edge to edge. Unlike known adhesives, the pressure sensitive adhesive layer 33 will not readily shift once it is positioned on the user and can be re-used repeatedly without losing its adhesive properties. The pressure sensitive adhesive layer 33 has an adhesion force to the breast forms 12 that is greater than a cohesion force to the user's skin. The pressure sensitive adhesive layer is further able to withstand tremendous movement and pressure from the user without slipping and can even be subjected to water or sweat without degeneration of the adhesive properties. In fact, if the pressure sensitive adhesive layer becomes dirty (i.e. collects unwanted particles such as dust, lint, or debris), it can be cleaned with soap and water to remove the unwanted particles and fully restore the adhesive properties.

The breast forms 12 are each adapted to accommodate the connector 14. The connector 14 can have many different forms, but generally will have two or more separate portions, where a first portion attaches to one breast form and a second portion attaches to the other breast form. The first and second portions of the connector are designed to engage each other in order to adjoin the two breast forms. Furthermore, the separate portions of the connector 14 can be either permanently or removably attached to the breast forms. It is also possible for the connector 14 to be a single unit that removably attaches to both breast forms. The manner in which the connector 14 attaches to the breast forms will vary depending on the particular structures of the breast forms and the connector.

The breast form system 10 shown in FIG. 1 can represent various combinations of breast forms 12 and connectors 14. In one embodiment, each of the breast forms 12 includes a volume of silicone gel material encased within a flexible thermoplastic film material, such as polyurethane or the like. The thermoplastic film material can be in the form of two separate sheets that are heat sealed together along a perimeter surface where the interior surface 30 and the exterior surface 32 meet. Additionally, the breast forms can further comprise an optional fabric layer that is permanently joined to the thermoplastic film material.

Figure 3:
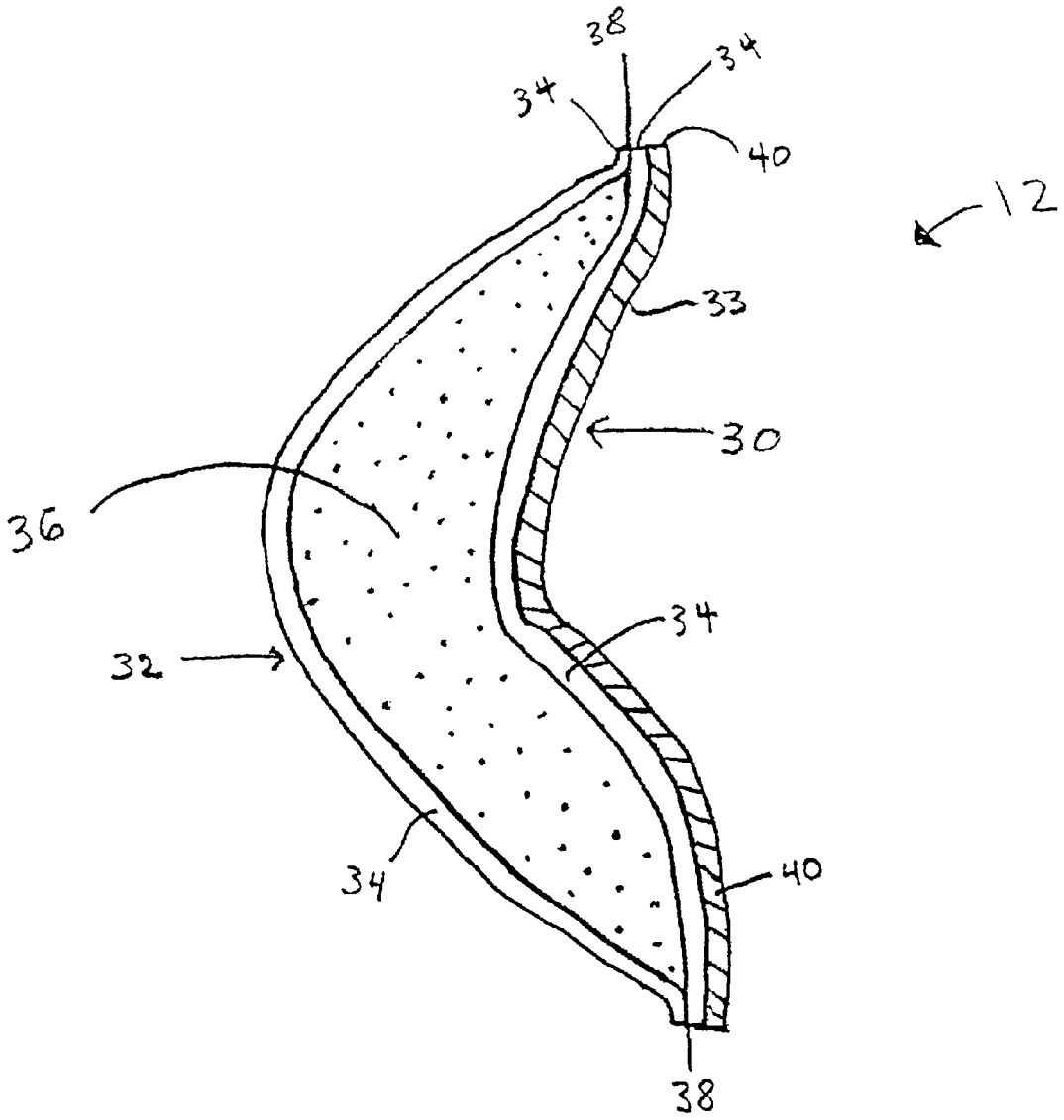
FIG. 3 is a side cross-sectional view of a breast form having a fabric layer adjoined to a thermoplastic film material.

The fabric layer and thermoplastic film material are permanently and inseparably adjoined by heat lamination or other similar processes. Referring to FIG. 3, a side cross-sectional view of the breast form 12 is shown, wherein the breast form has two sheets of thermoplastic film material 34 encasing a volume of silicone gel material 36, and one of the sheets also has an optional fabric layer. The two sheets 34 are heat sealed along the perimeter of the breast form along point 38. A fabric layer 40 is permanently adjoined to the sheet 34 that defines the interior surface 30. The pressure sensitive adhesive layer 33 is permanently grown to the fabric layer 40 from edge to edge. If desired, the fabric layer can be adjoined to the sheet defining the exterior surface 32, or can be adjoined to both sheets. The fabric layer 40 can be made from any suitable material, such as a two-way or four-way stretchable material that allows the breast form to conform to the user's breast shape.

Another embodiment of the breast form system includes one or more of the breast forms being specially designed to accommodate sagging breasts. Known breast forms are not well suited for women with sagging breasts because the breast forms have a greater thickness near the lower portion of the breast form, which would only further accentuate the sag in the user's breast when the breast form is positioned over the user's breast. A side-view of a breast form 120 that is designed to accommodate sagging breasts is shown in FIG. 4.

Figure 4:
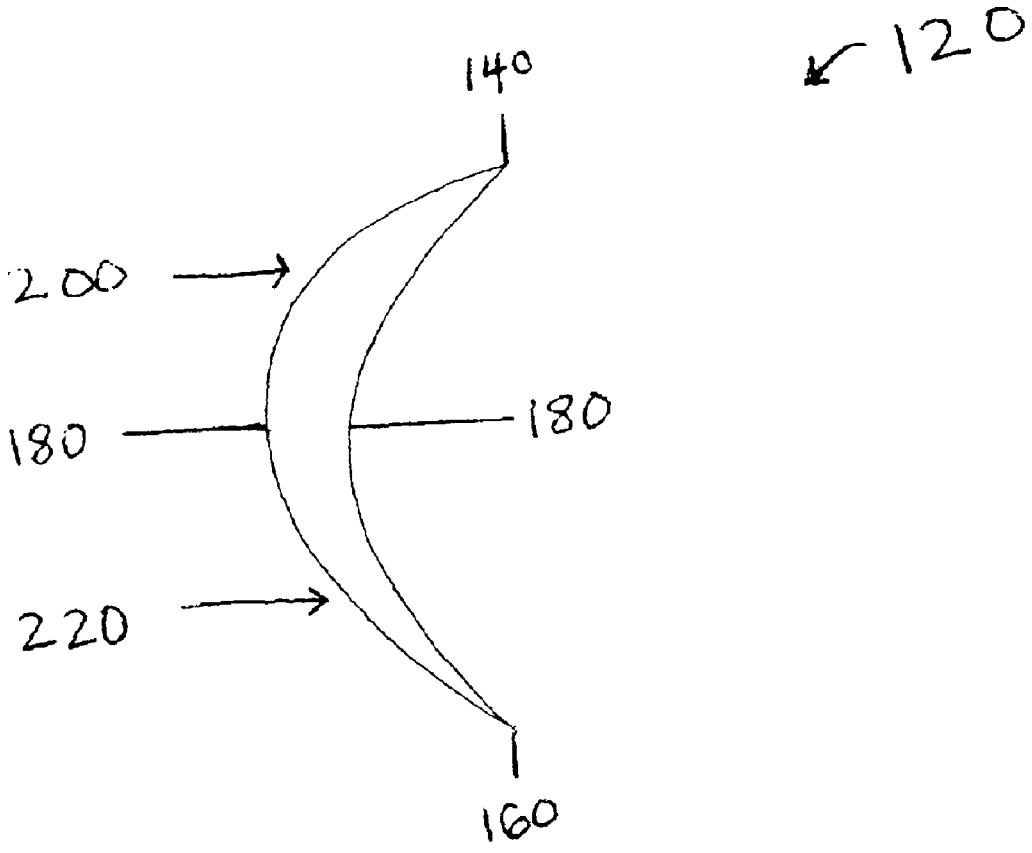
FIG. 4 is a side view of a breast form adapted to accommodate sagging breasts.

More specifically, the breast form 120 shown in FIG. 4 has a top 140 and a bottom 160 opposite the top. The breast form also defines an apex or center 180, which is approximately the middle distance between the top 140 and the bottom 160. The portion of the breast form above the center 180 defines an upper portion 200, and the portion below the center portion defines a lower portion 220. The breast form 120 has a greater thickness at the upper portion 200 than a thickness at the lower portion 220. This design feature is apparent from the side view in FIG. 4, where the thickness of the upper portion 200 is noticeably greater than the thickness of the lower portion 220. As a result, the breast form 120 will counterbalance the natural effects of gravity and sag in the user's breast by enhancing the size of the flatter, non-sagging portion of the breast (i.e. where the upper portion 200 will be positioned), thereby creating the appearance of a fuller, more evenly distributed breast.

The connector 14 can be adjoined to the breast form at the interior surface 30 or the exterior surface 32, or both surfaces. Further, the connector can be adjoined to either the thermoplastic film material or the fabric layer, or both. Because the particular material used to construct the breast forms will vary (i.e. thermoplastic film, rubber, fabric, etc.), the material to which the connector is adjoined should be able to withstand a number of different pulling forces without separating from the breast forms.

Figure 5A:
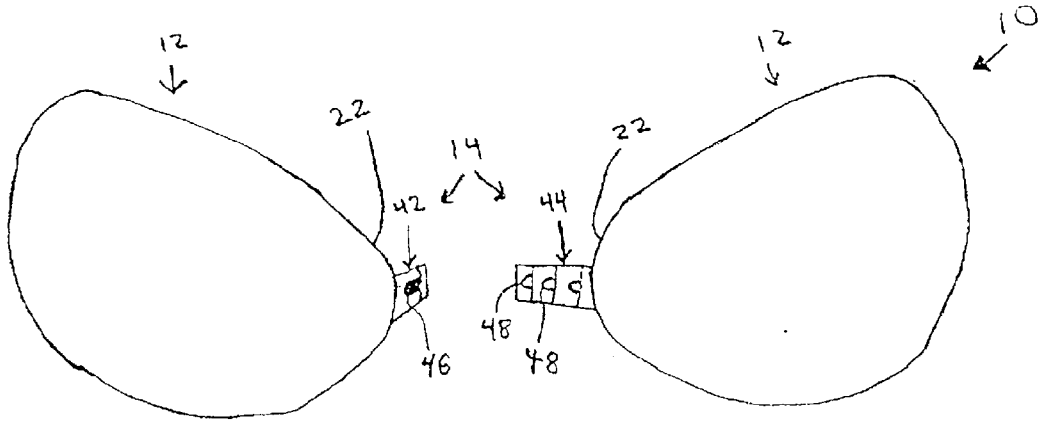
FIG. 5*a* is a front view of the breast form system of FIG. 1 having an adjustable connector that has not been engaged to adjoin the breast forms.
Figure 5B:
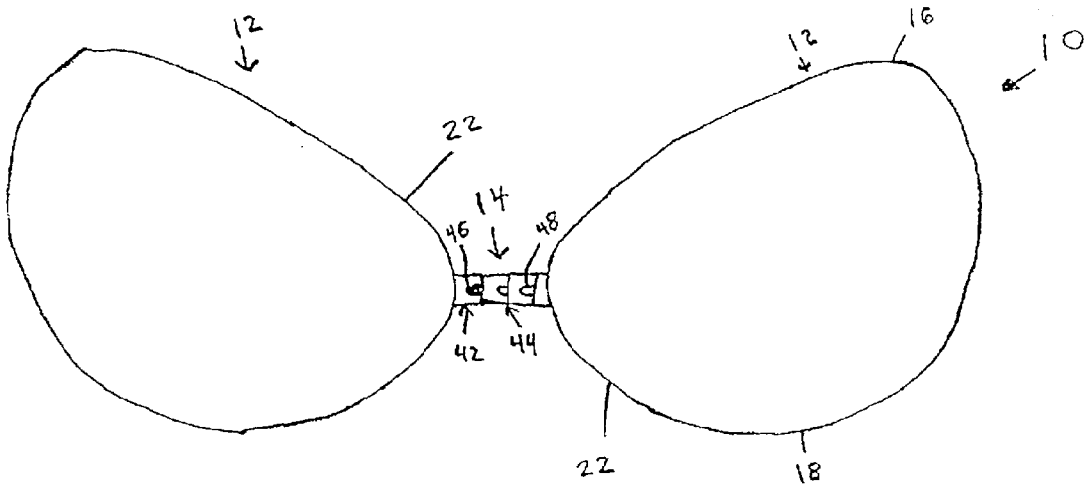
FIG. 5*b* is a front view of the breast form system of FIG. 5*a* wherein the connector has been engaged to adjoin the breast forms.

Referring to FIGS. 5*a* and 5*b*, the connector 14 is shown as an adjustable clasp assembly. In FIG. 5*a* the connector 14 has a first portion 42 attached to the inner side 22 of one of the breast forms 12, and a second portion 44 attached to the inner side 22 of the other breast form 12. The first portion and the second portion are designed to engage each other in order to adjoin the two breast forms. It does not matter to which of the breast forms the first portion 42 and the second portion 44 are attached, so long as the first and second portions are oriented towards each other in a manner that allows them to cooperatively engage. The first portion 42 is shown having a clasp 46 that is adapted to fit within a plurality of loops 48 that are disposed on the second portion 44. The first portion and second portion are shown prior to being engaged. FIG. 5*b* shows the first portion 42 engaged with the second portion 44, such that the connector 14 has adjoined the two breast forms 12. The clasp 46 is shown engaging the first of the three loops 48 of the second portion. Because the connector 14 is adjustable, the user could engage the clasp 46 with one of the other loops, which would result in the two breast forms being pulled closer towards each other, thereby creating more cleavage between the user's breasts.

In FIGS. 5*a* and 5*b*, the connector 14 is shown permanently fixed to the breast forms. More specifically, the first portion 42 and second portion 42 are permanently attached to the inner sides of the breast forms 12. However, it is possible for the first portion and second portion to be removably attached to the breast forms. For example, the first portion and second portion could attach to the breast forms by way of a button type assembly that snaps through a small hole in each of the breast forms. This would allows both portions of the connector to be removed from the breast forms, which would allow the user to wear the breast forms without adjoining the breast forms.

Figure 6:
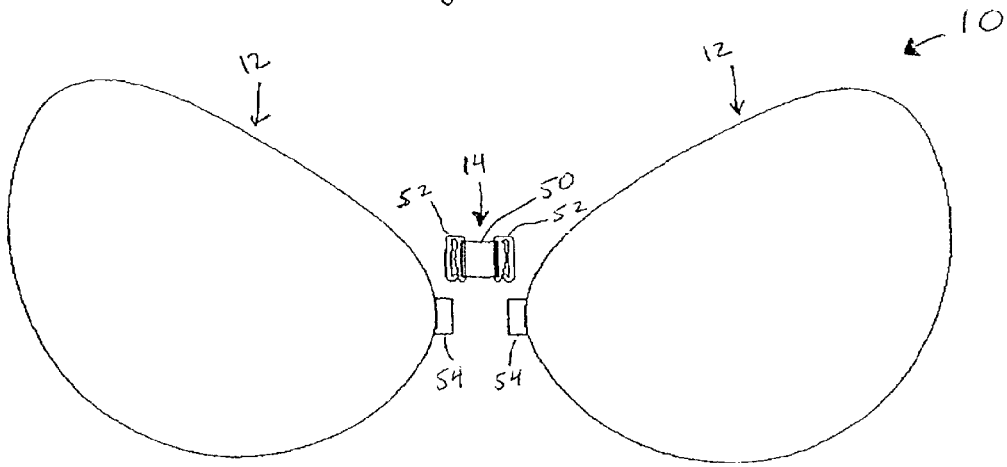
FIG. 6 is a front view of the breast form system of FIG. 1 having a single unit connector.

Another embodiment of the breast form system 10 is shown in FIG. 6. Again, the breast forms 12 can be any suitable type. The connector 14 is a single unit, as opposed to having two separate portions that adjoin. In the single unit shown, the connector 14 has a body 50 with a pair of hooks 52 attached at each end of the body. The body can be made of any suitable material such as plastic, metal, or various fabrics, such as an elastic fabric. The hooks 52 are adapted to slide into and engage a pair of loops 54 that are attached to the inner sides 22 of each breast forms. The loops 54 are shown permanently attached to the inner sides of each breast form, and have a size that provides for a snug fit between the hooks and the loops. The loops an be made to detach from the breast forms and can vary in size. Generally, the user will slide one of the hooks 52 into one of the loops 54, and then slide the other hook through the other loop, which adjoins the two breast forms together.

Figure 7:
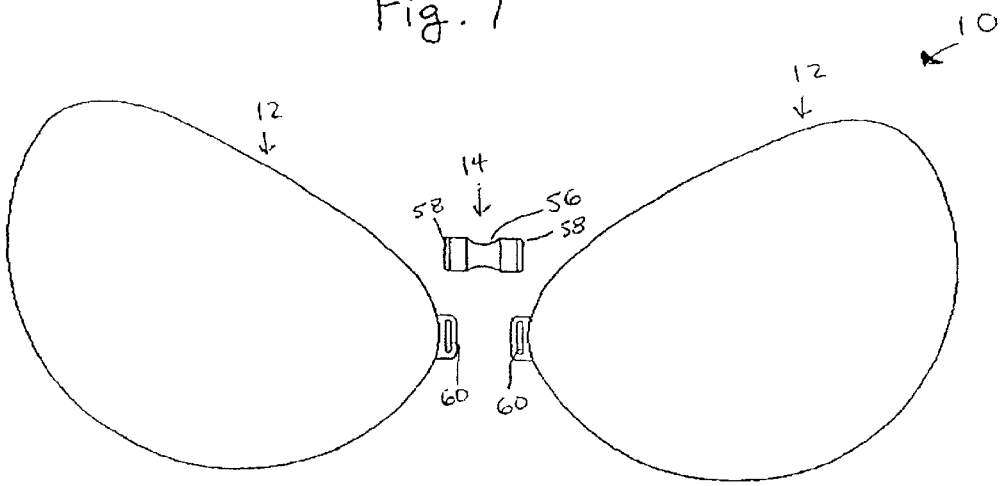
FIG. 7 is a front view of the breast form system of FIG. 6 having a different single unit connector.

Another embodiment of the connector 14 is shown in FIG. 7. Similar to FIG. 6, the connector 14 is a single unit that engages openings that extend from each breast form. The connector 14 has a rigid body 56 with a pair of rigid arms 58 extending from each end of the body. The arms 58 are adapted to snap into receptacles 60 that extend from the inner side of each breast form. Once the arms are snapped into the receptacles, the two breast forms are engaged.

The single unit connectors shown in FIGS. 6 and 7 can each be made into more than one piece, or configured to attach (either permanently or removably) to the one or more of the breast forms. For example, in FIG. 6, rather than having a pair of hooks 52 attached at both ends of the connector body 50, a single hook could be attached at one end of the body 50 and the other end of the body could be fixed to one of the breast forms. In this configuration, one breast form would have a loop 54 extending from its inner side, and the other breast form would have the body of the connector with a hook attached thereto. Therefore, it is understood that there are many possible configurations for the connector 14 and the manner in which it connects to the breast forms.

Figure 8:
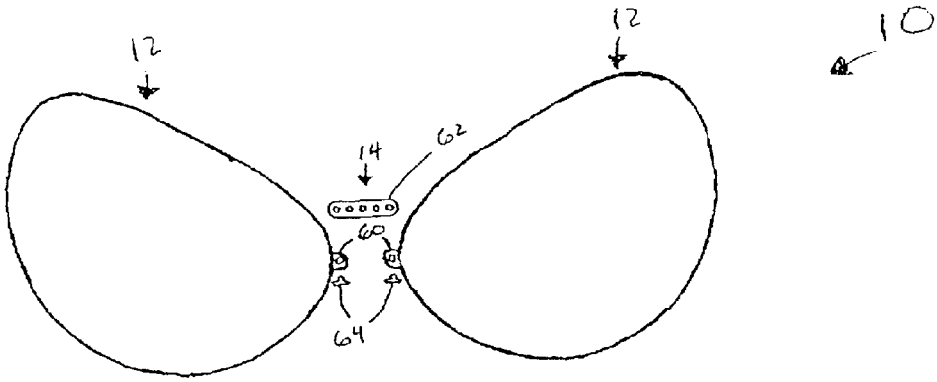
FIG. 8 is a front view of the breast form system of FIG. 1 having an adjustable connector assembly.

Further embodiments of the breast form system 10 can be achieved by making minor alterations to the connector 14 and the breast forms. For example, referring to FIG. 5*a*, the first portion 42 and the second portion 44 could be mating portions for a VELCRO strap, wherein the first portion includes a strip of nylon having a plurality of minute hooks and the second portion includes a corresponding strip with a surface of uncut pile. Also, the receptacles 60 shown in FIG. 7 could be changed in shape to be circular or could be made into metal or plastic rings. Further, the connector 14 could simply be a piece of string, or the like, that passes through the rings and allows the user to tie a knot to adjoin the two breast forms. An additional embodiment is shown in FIG. 8, wherein the connector 14 includes a mounting strap 62 and a pair of plugs 64. The mounting strap 62 has a plurality of holes that are adapted to engagingly receive the plugs 64. The breast forms each have a receptacle 60. The user adjoins the breast forms by aligning one of the holes on the mounting strap with each of the receptacles, and then inserting the plugs through the receptacles and mounting strap. The user can adjust the amount of breast cleavage by adjoining the breast forms closer together on the mounting strap.

Figure 10:
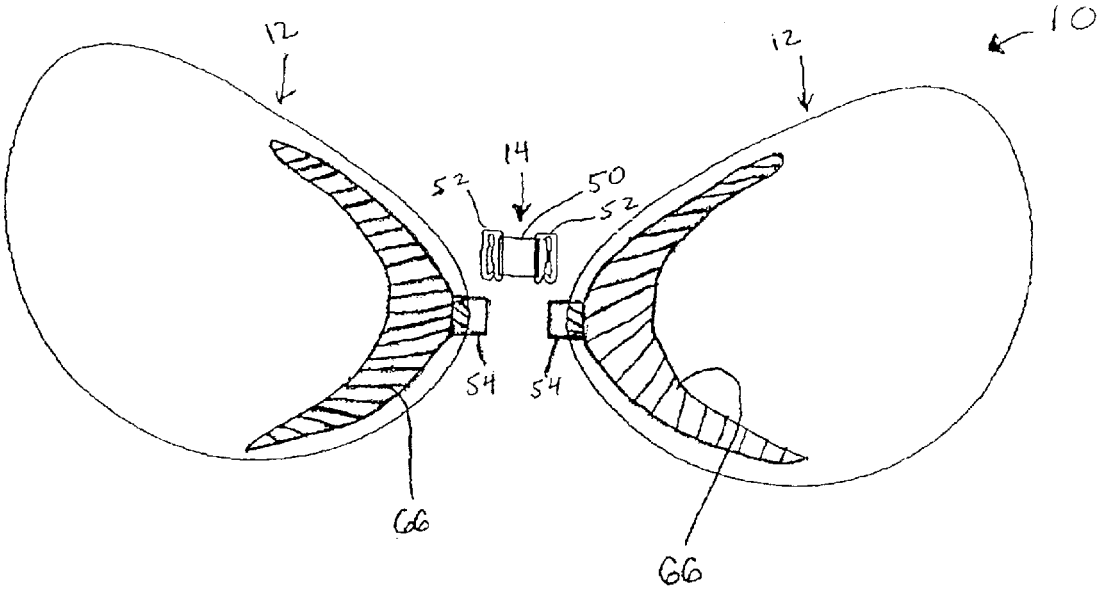
FIG. 10 is a front view of the breast form system of FIG. 6 wherein the connector includes a subassembly of connector patches.

The manner in which any of the permanently or removably attached portions of the connector are adjoined to the breast forms can vary. The same is true with respect to portions of the breast form that are adapted to engage the connector. The various portions of the connector and the breast form could be attached by stitching, heat sealing, adhesives, or any other suitable means. For example, the connector can be part of a sub-assembly that attaches to the breast forms. Referring to FIG. 10, the breast form system of FIG. 6 is shown further comprising a pair of connector patches 66. The connector patches 66 are each a subassembly that houses the loops 54, which receive the hooks 52 in order to adjoin the breast forms. Accordingly, the loops are integrally joined to the connector patches 66, which separately adjoin to the breast forms. The connector patches can have many different shapes and sizes, and can be made from a number of materials, such as a fabric of film material. For example, if the subassembly is made of a thermoplastic film, then it can be heat sealed to the interior or exterior surface of the breast form, or the connector patch can have a permanently grown adhesive that allows the subassembly to be removably attached to the breast form. Therefore, many options exist for adjoining the connector with the breast forms.

The various features of the breast form system 10 allow it to serve as a replacement for the traditional bra, yet also provide breast size and shape enhancement. Moreover, the user is able to customize the amount of breast cleavage and push-up enhancement. Unlike traditional bras, the present breast form system 10 has no straps or cups that are usually necessary to hold the user's breasts or an external breast form or enhancement device. The user can wear the present breast form system without needing to wear any other type of bra. The presence of both the pressure sensitive adhesive layer and the connector makes the present breast form different than currently available bras and enhancement systems. Because the breast forms are positioned directly onto the user's breasts, and because of the specially designed pressure sensitive adhesive layer, the breast forms will remain in the desired position until the user removes them. Furthermore, the user can wear the present breast form system with nearly all possible types of clothing. The outline and structure of the present breast form system is not visible under even the tightest articles of clothing. Additionally, the breast forms can be made of is silicone gel that makes the breast forms so realistic that the breast form system will not be detected by others even when hugging the user.

The present breast form enhancement system allows users to boost their self-esteem without turning to dangerous, or cumbersome, alternatives currently available. Moreover, the present system is well adapted for post-mastectomy patients because the left and right breast forms can be easily made in different sizes. Because the breast forms are individual units, a user can mix and match different sizes to fit their particular needs, and still achieve the full benefits of the enhancement system by including the connector.

Once the user adjoins the breast forms to their skin and creates the desired look and shape, the user can create greater cleavage by pulling the breast forms together to engage the connector. Furthermore, if the user wants to push-up the breasts, the user can position the breast forms at a lower and more outward position on the breasts, and then adjoin the breast forms with the connector, or can select a breast form system that positions the connector a lower region of the breast forms.

Figure 9:
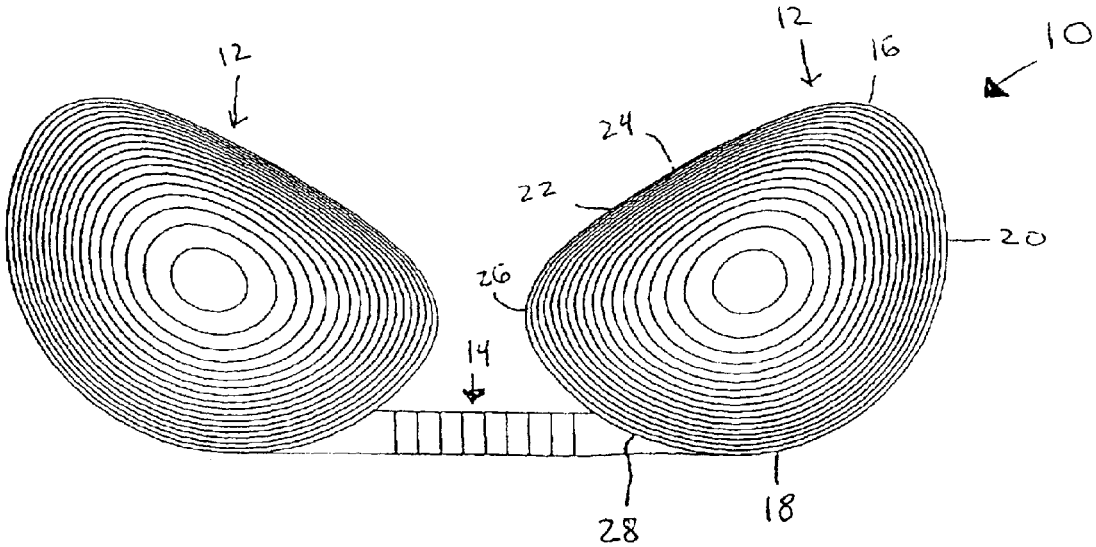
FIG. 9 is a front view of the breast form system of FIG. 1 wherein the connector is positioned between the bottom inner portions of the breast forms.

The placement of the connector relative to the top 16 and bottom 18 of the breast forms will control the amount of push-up enhancement. For example, compare the positioning of the connector 14 in FIG. 9 to the positioning of the connector 14 in FIG. 1. The connector in FIG. 1 is positioned at the inner middle 26 portion of the breast forms. The connector in FIG. 9 is positioned at the inner bottom 28 portion of the breast forms and, as a result, when the breast forms are adjoined by pulling them together to engage the connector, the user's breasts are pulled together and pushed upward. Therefore, the present breast form system 10 provides more or less push-up enhancement by regulating the placement of the connector.

In addition to the specific features and embodiments described above, it is understood that the present invention includes all equivalents to the structures and systems described herein, and is not to be limited to the disclosed embodiments. For example, the connector can be made an integral portion of the breast forms that is either attached or removable. Individuals skilled in the art to which the present breast form enhancement system pertains will understand that variations and modifications to the embodiments described can be used beneficially without departing from the scope of the invention.

What is claimed is:

1. An improved backless, strapless breast form system to be worn in place of a traditional bra, comprising:

a pair of breast forms, wherein each breast form comprises:

a volume of silicone gel encased between thermoplastic film material;

a concave interior surface, the interior surface facing towards a user's breast, wherein substantially the entire interior surface from edge to edge comprises a pressure sensitive adhesive layer disposed thereon for adjoining the breast form to the user's breast;

an outer side facing towards the user's armpit, and an inner side facing opposite the outer side, wherein the breast form is secured to the user's breast solely by the pressure sensitive adhesive layer; and a connector adapted to adjoin the breast forms, wherein the connector is positioned between the inner sides of each of the breast forms.

2. The breast form system of claim 1 wherein the connector comprises a first portion attached to one of the breast forms and a second portion attached to the other of the breast forms, and the first portion and the second portion are adapted to cooperatively engage.

3. The breast form system of claim 2 wherein the first portion and the second portion are removably attached to the breast forms.

4. The breast form system of claim 1 wherein the connector is a single unit adapted to engage inner side surfaces of the breast forms.

5. The breast form system of claim 1 wherein the pressure sensitive adhesive layer has an adhesion force to the interior surface of the breast forms that is greater than a cohesion force to the user's skin.

6. The breast form system of claim 1 wherein at least one of the breast forms comprises an upper portion and a lower portion, the upper portion having a greater thickness than the lower portion.

7. The breast form system of claim 1 wherein the pressure sensitive adhesive layer is integrally fanned on the interior surface.

* * * * *

UNITED STATES PATENT AND TRADEMARK OFFICE

CERTIFICATE OF CORRECTION

PATENT NO. : 6,758,720 B2
DATED : July 6, 2004
INVENTOR(S) : Chen et al.

It is certified that error appears in the above-identified patent and that said Letters Patent is hereby corrected as shown below:

Title page,

Item [75], Inventor, insert -- Jasper Chang, Diamond Bar, CA (US);
Alice Chang, Diamond Bar, CA (US) --.

Item [*] Notice, after "subject to any disclaimer, the term of this patent is extended or adjusted under 35 U.S.C. 154(b) by 52 days."
insert -- This patent is subject to a terminal disclaimer. --.

Item [56], References Cited, OTHER PUBLICATIONS, "Dr. Leonard's…" reference, delete "Silicon" and insert -- Silicone --.

Column 10,

Line 2, delete "fanned" and insert -- formed --.

Signed and Sealed this

First Day of November, 2005

JON W. DUDAS
*Director of the United States Patent and Trademark Office*